US005603177A

United States Patent [19]

Saunders

[11] Patent Number: 5,603,177

[45] Date of Patent: Feb. 18, 1997

[54] ANIMATED DISPLAY

[76] Inventor: Darren G. Saunders, Ravenswood Park, Bonvilston, Cardiff, United Kingdom

[21] Appl. No.: 374,628

[22] PCT Filed: Jul. 13, 1993

[86] PCT No.: PCT/GB93/01468

§ 371 Date: Jan. 17, 1995

§ 102(e) Date: Jan. 17, 1995

[87] PCT Pub. No.: WO94/01188

PCT Pub. Date: Jan. 20, 1994

[30] Foreign Application Priority Data

Jul. 14, 1992 [GB] United Kingdom ..... 9214927
Nov. 28, 1992 [GB] United Kingdom ..... 9224982

[51] Int. Cl.[6] ..... G09F 19/08

[52] U.S. Cl. ..... 40/418; 40/411; 446/354

[58] Field of Search ..... 40/411, 414, 418, 40/419, 420; 446/354, 355, 362, 385

[56] References Cited

U.S. PATENT DOCUMENTS

| | | | |
|---|---|---|---|
| 3,456,384 | 7/1969 | Gardel et al. | 446/355 |
| 3,599,364 | 8/1971 | Garcia | 446/355 |
| 4,244,141 | 1/1981 | Douglas et al. | 446/355 |
| 4,263,741 | 4/1981 | Koshiya . | |
| 4,901,459 | 2/1990 | Lee | 40/414 |
| 4,944,708 | 7/1990 | Kawabe | 446/355 X |
| 5,066,259 | 11/1991 | Acker | 446/385 |
| 5,224,896 | 7/1993 | Terzian | 446/354 X |

FOREIGN PATENT DOCUMENTS

| | | |
|---|---|---|
| 603398 | 4/1926 | France . |
| 303613 | 2/1918 | Germany . |
| 449132 | 9/1927 | Germany . |
| 504987 | 7/1930 | Germany . |
| 887474 | 7/1949 | Germany . |
| 1146416 | 3/1963 | Germany . |

*Primary Examiner*—Brian K. Green
*Attorney, Agent, or Firm*—Young & Thompson

[57] ABSTRACT

An animated display comprises a frame (16), arms (46) pivotted to an upper part of the frame and articulated legs (36, 54, 55) pivotted to a lower part of the frame. The arms and legs are pivotted and articulated by a common drive which includes a rocker bar 26 driven by an electric motor (18).

16 Claims, 9 Drawing Sheets

ANIMATED DISPLAY

FIELD OF THE INVENTION

This invention relates to an animated display and in particular, though not exclusively, to such a display which reproduces the walking or running action of the male or female human body.

BACKGROUND OF THE INVENTION

Animated displays exist at present for so-called animated tableaux seen in shops and arcades, and other public places around Christmas time, or on fairground organs and so on. In such displays each figure is only capable of very limited movement, for example turning the head back and forth, or raising and lowering an arm, and the display does not simulate lifelike movement. With such existing arrangements it is difficult if not impossible to provide realistic fluid movement.

Complex animatronic devices exist for simulating human or animal movements but these are extremely expensive to produce and require extensive computer or electronic programming.

SUMMARY OF THE INVENTION

I have found that by selecting a natural rhythmic motion of a human or animal, such as walking or running, it is possible to provide an apparatus operating on a cyclic basis for reproducing a fluid movement of the human or animal action without requiring the complexity of construction, or programming of the animatronic display.

Accordingly, in one aspect, this invention provides an animated display comprising a support frame means, two leg members pivotally mounted in an upper end region with respect to said support frame means, and drive means for reciprocating said leg members thereby to simulate the walking or running action of a human or animal.

In this invention, the term "running" should be interpreted broadly as including jogging, walking, and sprinting.

In another aspect, this invention provides an articulatable limb for simulating a human or animal limb or tail or other flexible body part, which comprises an inner articulatable frame part at least partially encased by a casing of foam, rubber, or rubber-like material.

Whilst the invention has been described above it includes any inventive combinations of the features set out above or in the following description.

BRIEF DESCRIPTION OF THE DRAWINGS

The invention may be performed in various ways and two embodiments and methods of construction thereof will now be described in detail, reference being made to the accompanying drawings in which.

DESCRIPTION OF THE PREFERRED EMBODIMENTS

Figure 1:
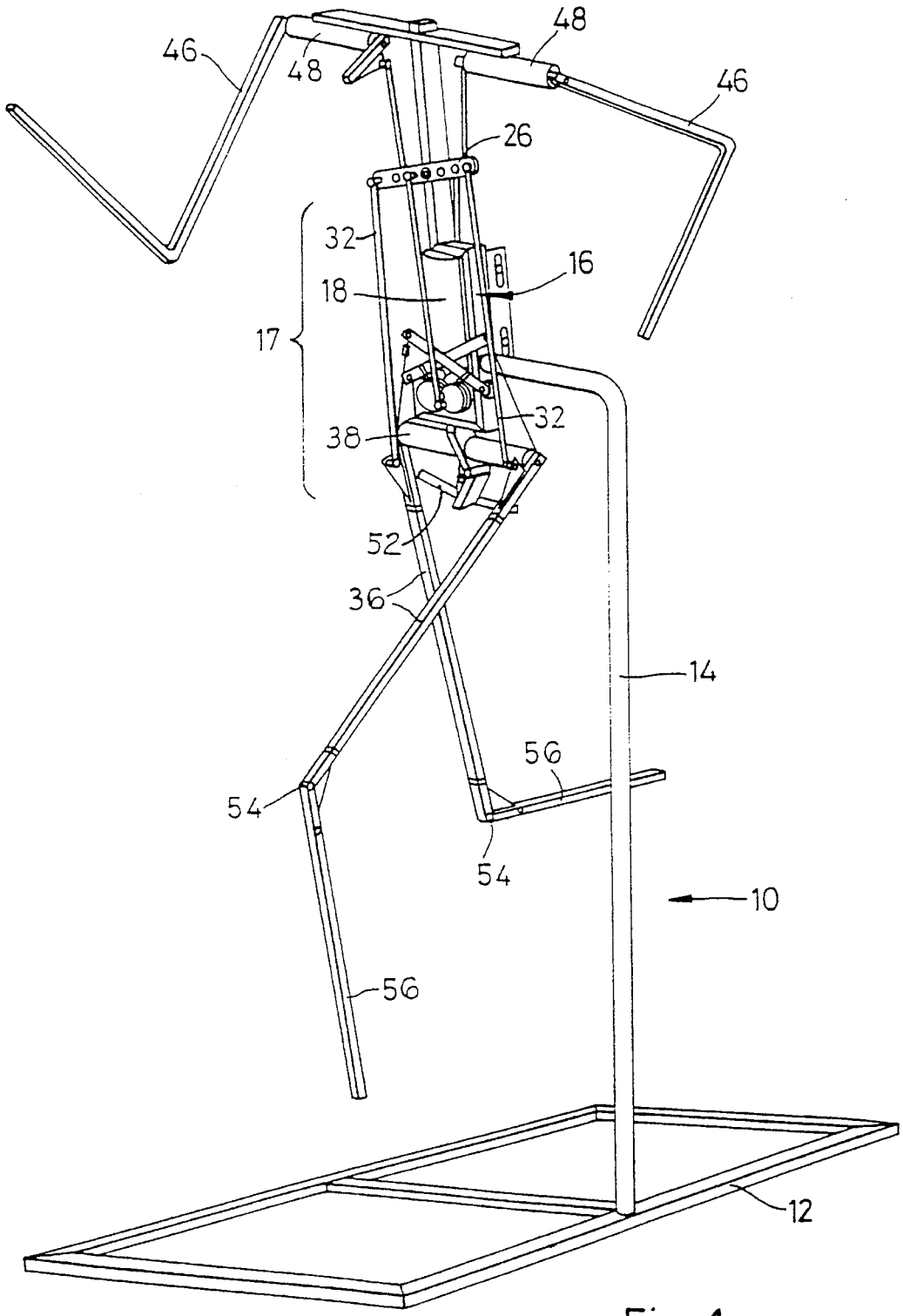
FIG. 1 is a general perspective view of a first embodiment of animated display for simulating the walking or running action of a human.
Figure 2:
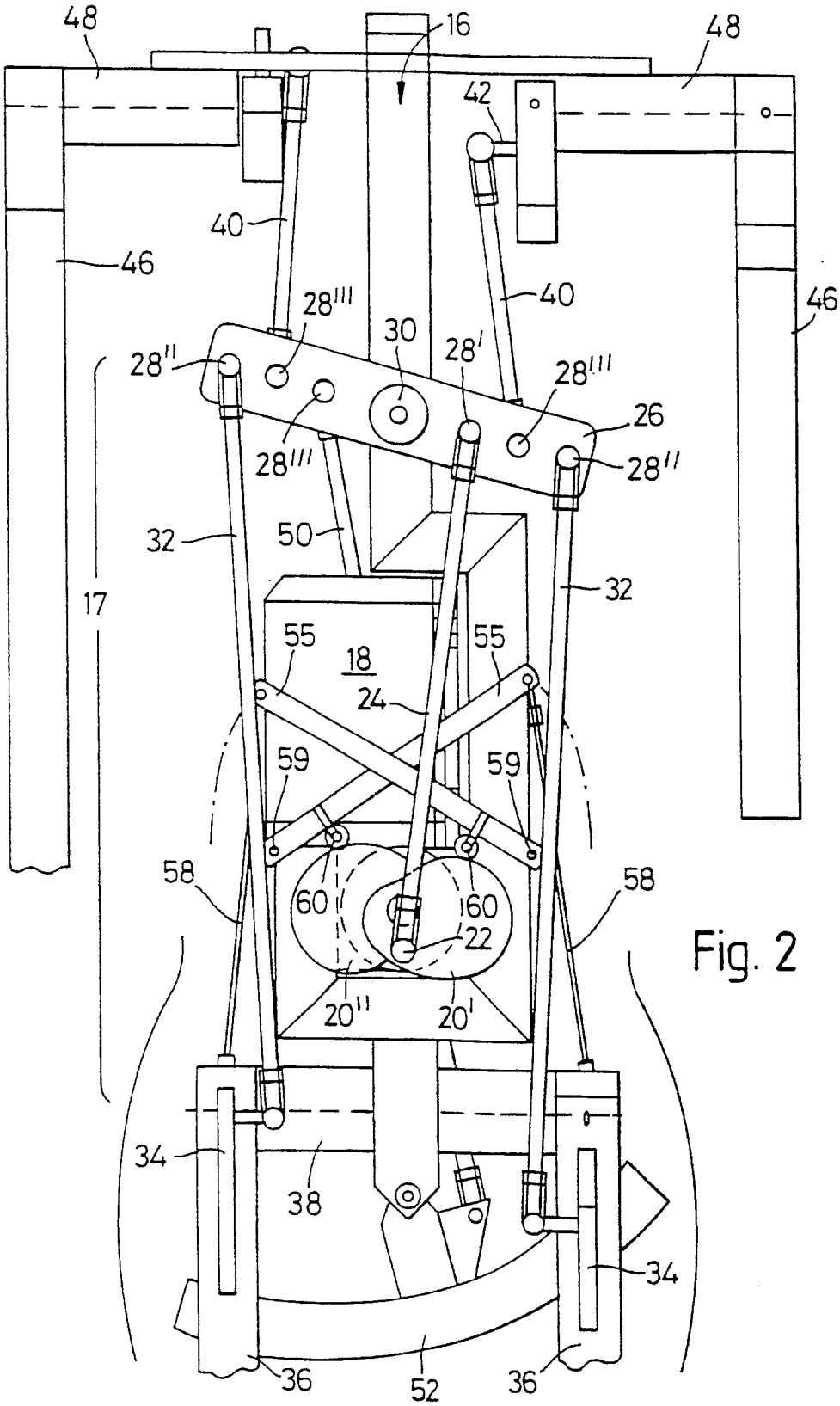
FIG. 2 is a front view of the central part of the embodiment of FIG. 1.
Figure 3:
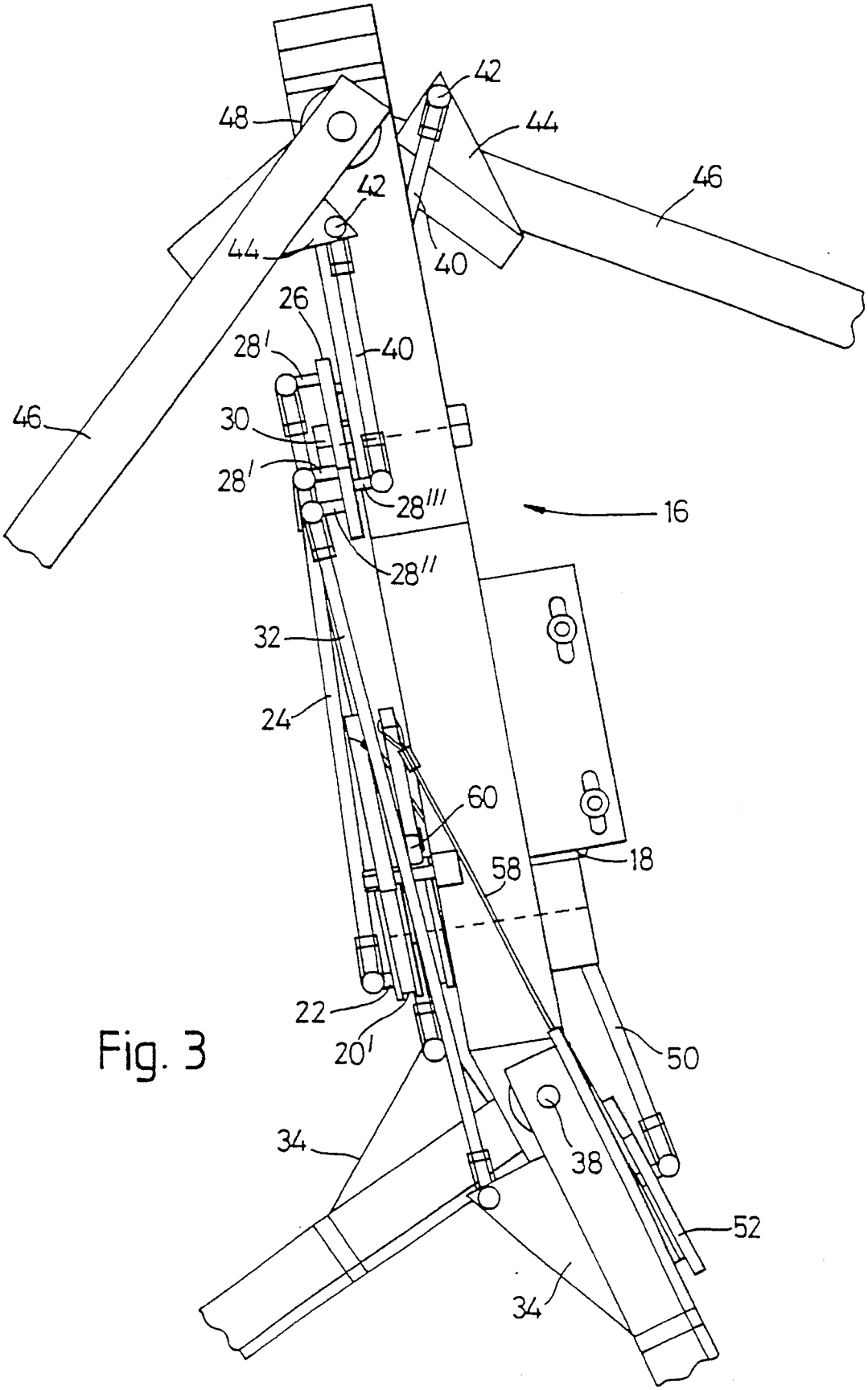
FIG. 3 is a side view of the central part of the embodiment of FIG. 1.

Referring initially to the embodiment of FIGS. 1 to 4, the display comprises a support stand 10 having a base 12, and a column 14 of inverted L-shape, the upper free end of which is connected to the support frame 16. The support frame 16 comprises a series of frame sections interconnected to support the drive motor 18 and the moveable limbs of the display. The drive motor drives a mechanism 17 which controls the movements of the limbs. This mechanism is indicated generally in FIG. 1 but in more detail in FIGS. 2 and 3; the motor drives, via a 90° gearbox, two symmetrically opposed cams 20', 20" whose function will be explained below. Eccentrically mounted on the outer cam 20" is a projecting finger 22 terminating in a ball which fits in a socket in the end of a link 24. The other end of the link has a socket which fits over a finger 28' attached to a rocking bar 26 pivotally mounted at 30 to an upper region of the frame 16. The rocking bar 26 has five further projecting fingers which drive the arms, legs and hip sway mechanism in required phase.

Thus, the outermost fingers 28" at either end of the rocking bar are connected via ball and socket joints to respective left and right links 32 which connect at their lower ends to transversely extending fingers which project from triangular fillets 34 which are attached to the front of the upper part or thigh 36 of the legs. At their upper ends the thighs are pivotally connected to a transverse hip shaft 38 secured to the support frame.

The two next inner fingers 28'" are attached via ball and socket joints and links 40 to fingers 42 on triangular shoulder fillets 44 connected to inner ends of the arm members 46. Each arm member is pivotally mounted on the support frame 16 by a shoulder tube 48.

The inner finger 28"" symmetrically opposed to the drive finger 28' is connected via a link 50 and ball joints to a curved hip bar 52 which moves the "buttocks" or "hips" of the mannequin in correct phase with the leg movement to simulate the female moving or walking action. On each side, preferably the hip rises as the leg moves forwardly through the vertical position.

When the motor is switched on, it causes the rocking bar 26 to oscillate through an arc dependent on the eccentricity of the projecting finger 22 relative to the rotational axis of the cams 20', 20". The rocking bar thus causes the left and right thighs to move in antiphase and likewise the left and right arms. Because the leg fillets 34 extend forwardly of the pivotal connection of the hip shaft 38, and the shoulder fillets 44 extend rearwardly of the pivotal connection to the shoulder tube, on each side of the body, the arm and leg move in antiphase, i.e. the arm is lifted rearwardly as the leg is lifted forwardly.

At their lower ends, the thighs 36 are articulated at knees 54 to lower leg members 56. Articulation of each leg is controlled via a Bowden (RTM) or similar cable drive comprising a cable 58 connected at its lower end to the lower leg and extending through the inner part of the thigh 36, to be connected to the upper end of a respective actuating rod 55. The lower end of each rod is pivotally attached at 59 to the support frame 16, and adjacent the lower end is a roller 60 which acts as a cam follower on a respective cam 20', 20". As the motor 18 rotates and drives the arms and thighs, so the cams 20' and 20" articulate the lower legs in a mechanically programmed manner to simulate the required movement.

Figure 4B:
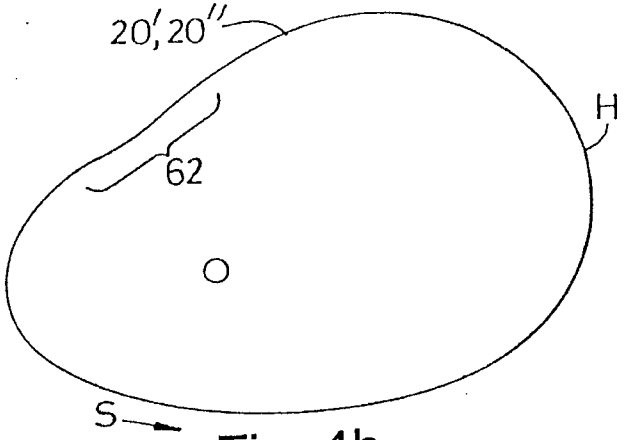
FIGS. 4 (*a*),(*b*),(*c*) are views showing the cam profiles for the embodiment of FIG. 1, for sprinting, jogging and walking respectively.
Figure 4C:
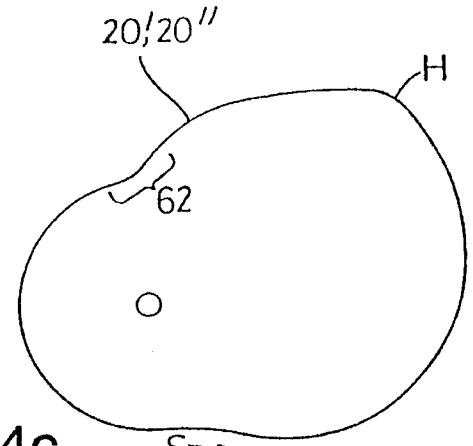
Figure 4A:
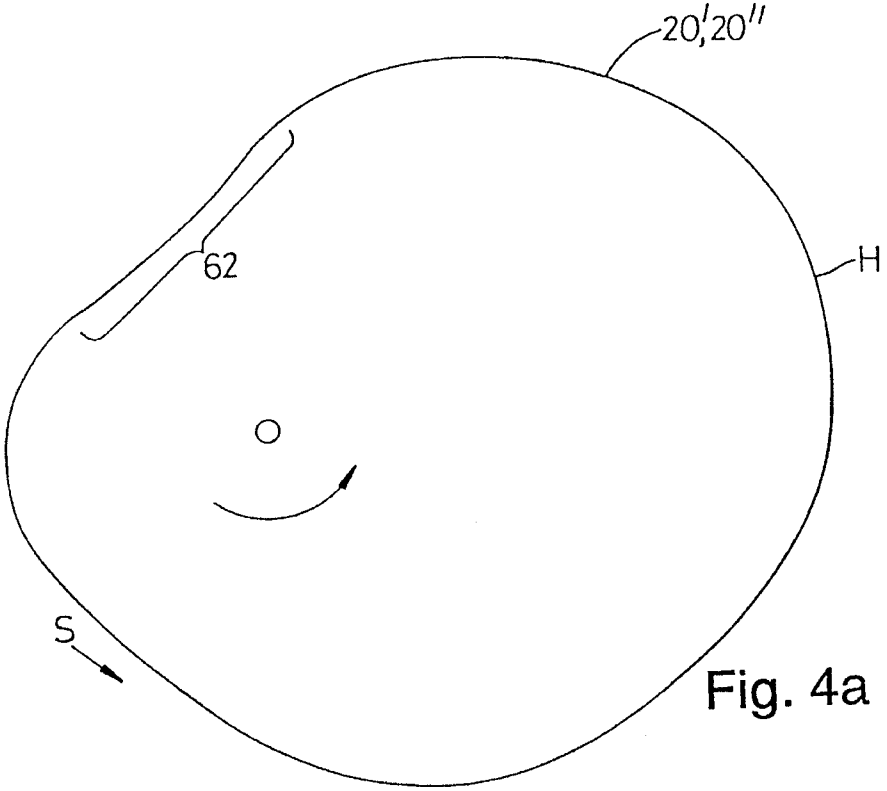

Ideally, different cams are used for different actions such as sprinting, jogging and walking (see FIGS. 4(*a*),(*b*) and (*c*)). In each Figure, S denotes the start of the cycle (i.e. when the leg is vertical, in line with the body). and H denotes the highest lift of the lower leg member. Common to each cam profile is a concave region 62, which corresponds to when the foot is in contact with the ground. Apart from this, the separation of the profile from the axis C determines the extent of lift and as can be seen, this increases with progression from walking, to jogging to running. The cam profiles are designed from analysis of the walking, jogging, sprinting movements of various athletes.

I have also found that the extent of throw, and the centre of throw relative to the body for both the arms and the legs vary according to the speed of movement. In the first embodiment, the extent of throw may be adjusted relatively simply by adjusting the extent of movement of the rocking bar 26, e.g. by adjusting the eccentricity of finger 22. This will adjust the extents of movement of the arms and thighs in common. The centres of throw may be adjusted by extending or shortening the length of the linked connection the rocker bar to the arms 46 and the thighs 36.

Thus, when the motor is operated, the arms, thighs, lower legs and hips/buttocks all move in predetermined relationship. For walking the "body" should be approximately vertical, but for walking, jogging, sprinting, it should lean forward by 10° or so. The extents and orientations of the throws are preferably as set out in the following table:

| | Forward leg throw | Rearward leg throw | Total leg throw | Forward arm throw | Rearward arm throw | Total arm throw |
|---|---|---|---|---|---|---|
| Walk | 35° | 10° | 45° | 0° | 30° | 30° |
| Jog | 40° | 10° | 50° | 0° | 60° | 60° |
| Run | 50° | 15° | 65° | 15° | 70° | 85° |
| Sprint | 65° | 15° | 80° | 50° | 70° | 120° |

When walking, the forearm is usually vertical, but when running, jogging, sprinting, it is usually at about 80° to the upper arm.

Figure 5:
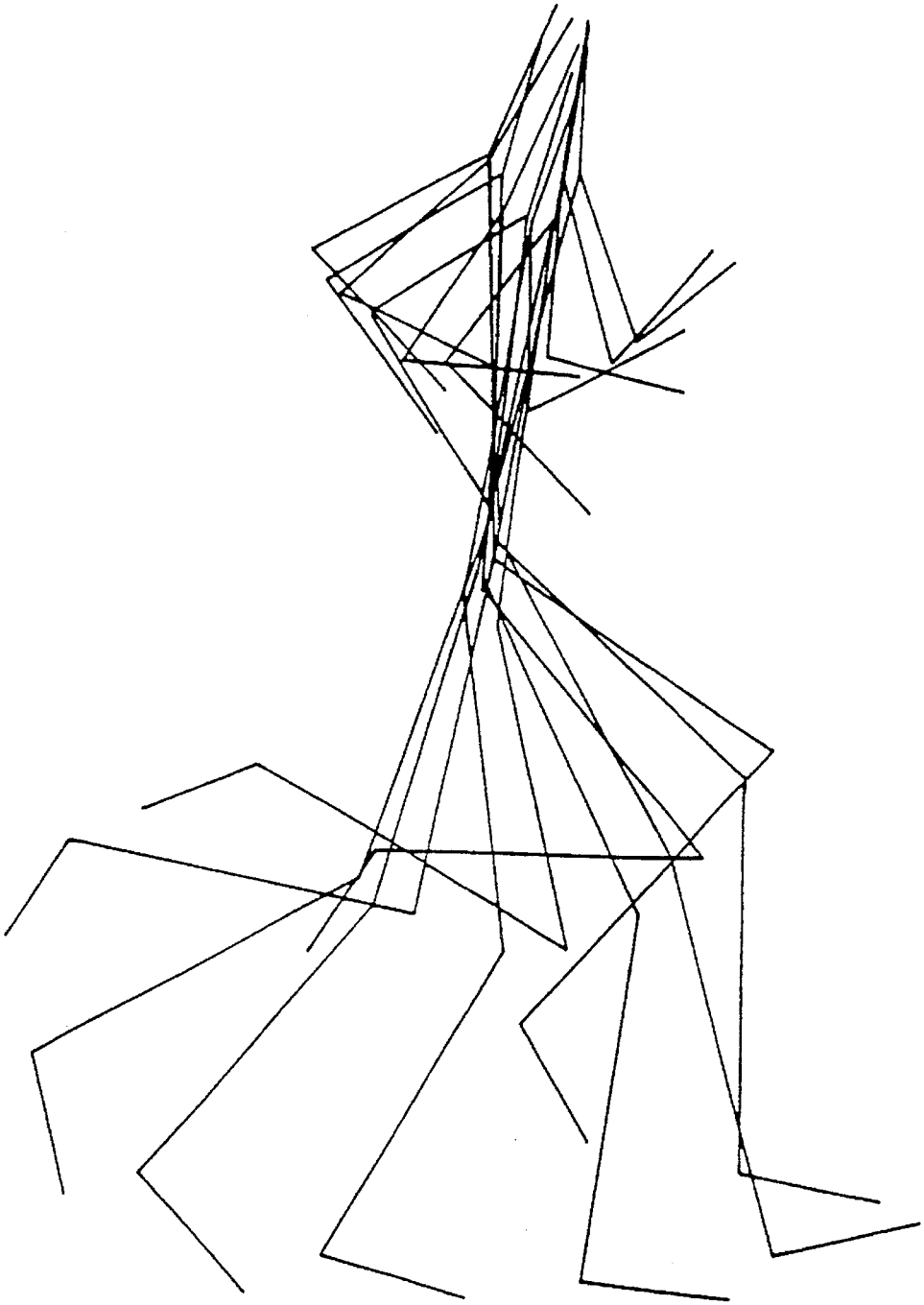
FIG. 5 is a montage showing the arm and leg movements of a human sprinting.

FIG. 5 shows a montage illustrating the motion of one arm and one leg of the human body. From this, the angular positions and articulation throughout the sprinting cycle can be seen.

Figure 6:
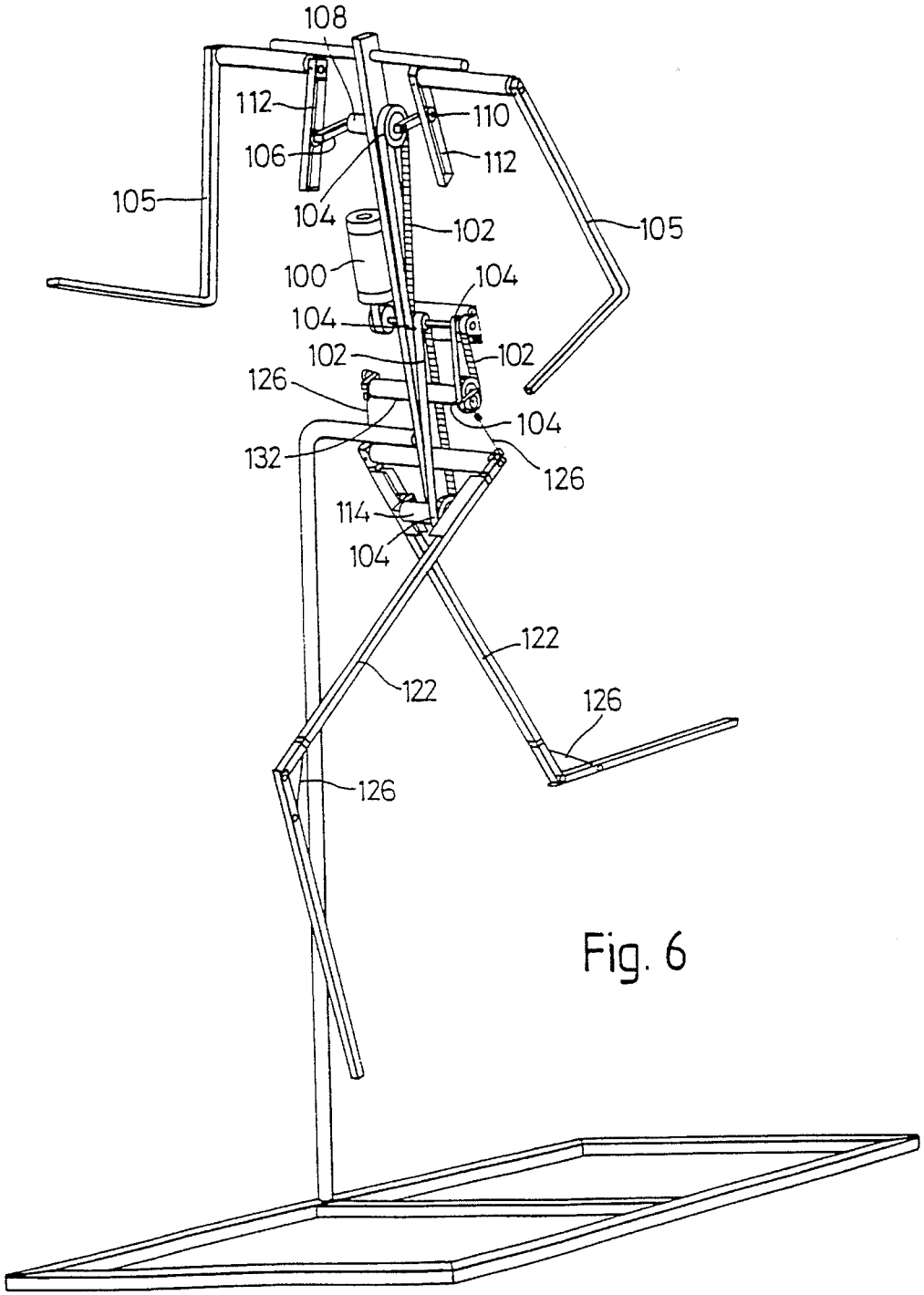
FIG. 6 is a general perspective view of a second embodiment of animated display for simulating the walking or running action of a human.
Figure 7:
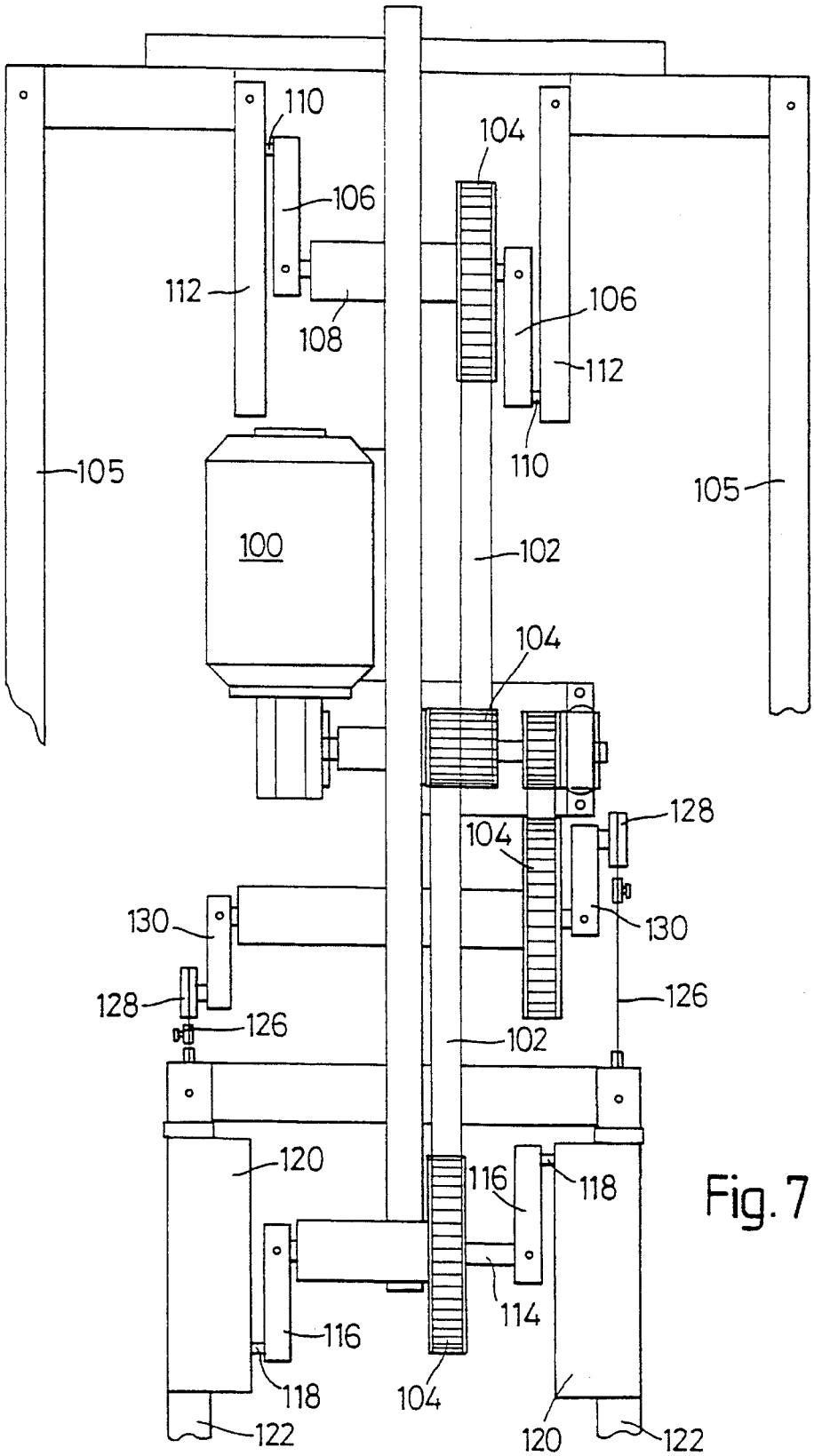
FIG. 7 is a front view of the central part of the embodiment of FIG. 6.
Figure 8:
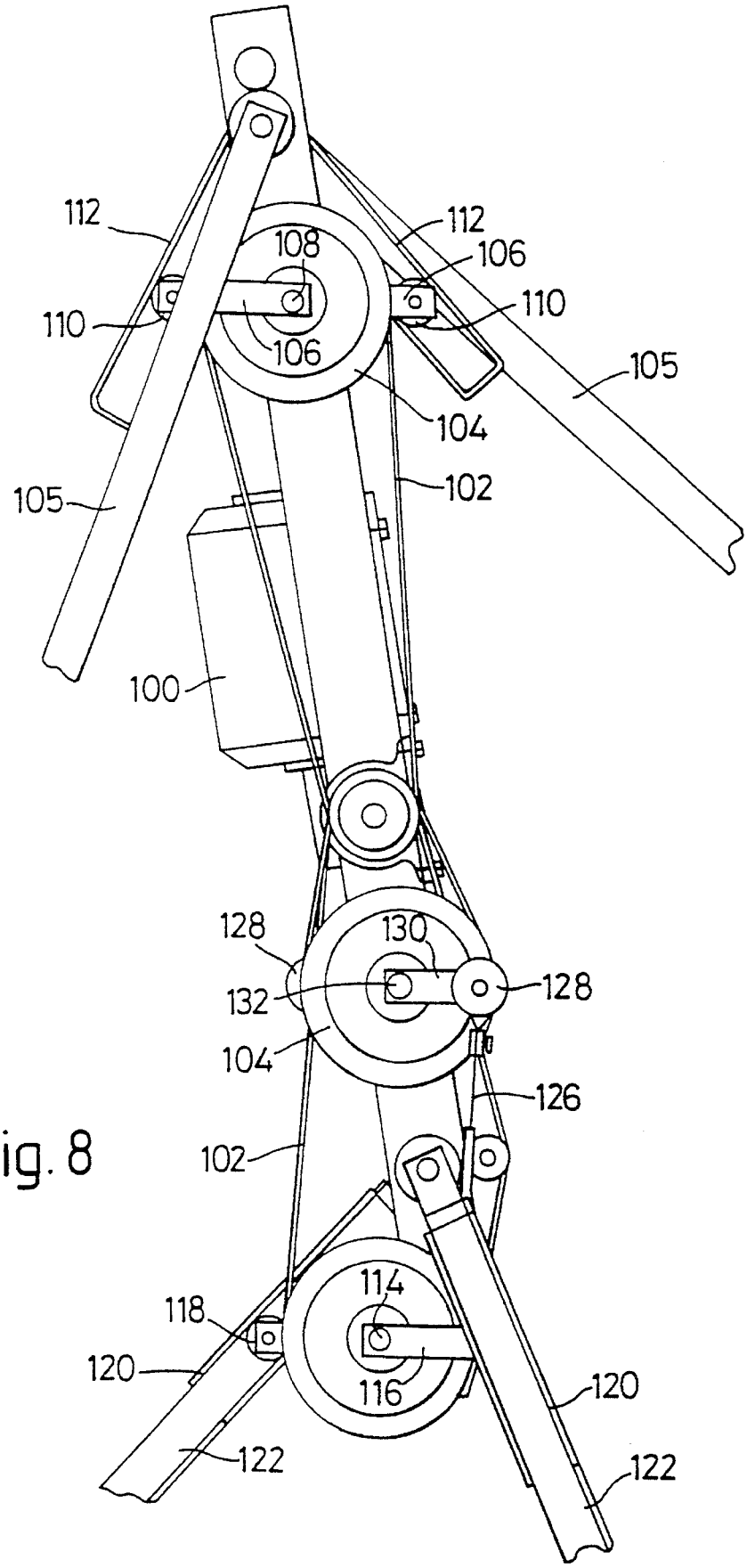
FIG. 8 is a side view of the central part of the embodiment of FIG. 6.

Referring now to the embodiment of FIGS. 6 to 8, the arm members, thigh members and lower leg members are pivotally mounted or articulated as above but the mechanism for applying controlled movement to each limb is different. Here, a motor 100 supplies drive to each part by means of a system of toothed belts 102, and pulleys 104.

Reciprocal drive is applied to the arms 105 by means of two oppositely directed cranks 106 at each end of a shaft 108. The cranks each have a projecting drive finger 110 which is located in a slot or guide 112 secured to the arms. As the shaft 108 rotates, so the arms 104 are moved reciprocally.

A similar arrangement drives the legs reciprocally via a shaft 114, cranks 116, and fingers 118 running in slots or guides 120 attached to the upper legs 122.

The lower legs are articulated as before by means of a cable drive. The upper end of each cable 126 passes around a respective retainer 128 rotatably mounted on a crank 130 secured to the end of a driven shaft 132. As the driven shaft 132 rotates, the upper end of each cable describes a circle, thus alternately lifting and lowering the lower leg, in phase with the movement of the limbs.

Actuation of the motor causes the arms, thighs, and lower legs to move in predetermined manner as determined by the geometry of the system. The extent of throw and centre of throw and the "lift" of the lower leg may be adjusted by adjusting the eccentricity of the cranks and the relative positions of the elements. For example, the drive shafts could be moved forwardly or rearwardly relative to the frame to shift the centre of throw. In this connection it will be noted in FIG. 7 that the leg drive shaft 114 is mounted forwardly of the frame.

Figure 9A:
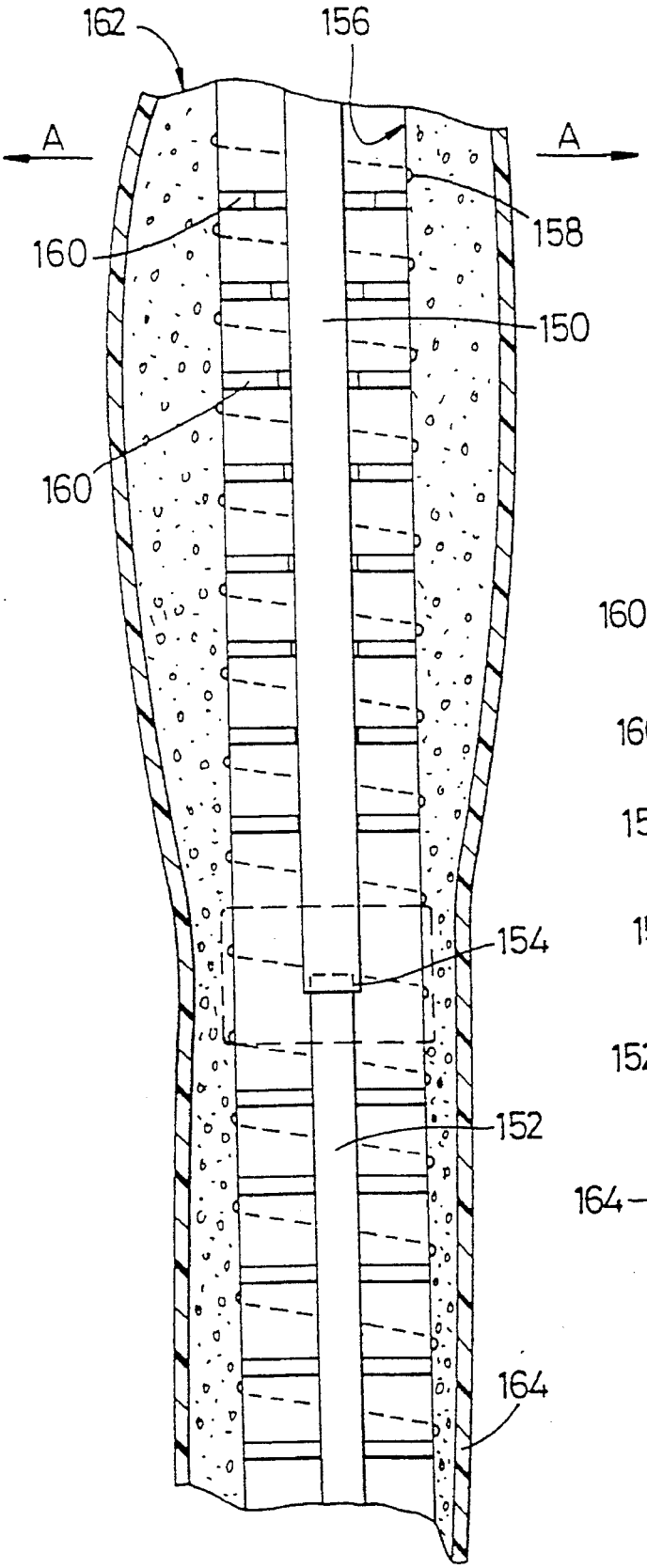
FIGS. 9(*a*) and (*b*) are schematic views showing a front and side view respectively of an articulated limb and surrounding structure for simulating a human limb for the first or second embodiments.
Figure 9B:
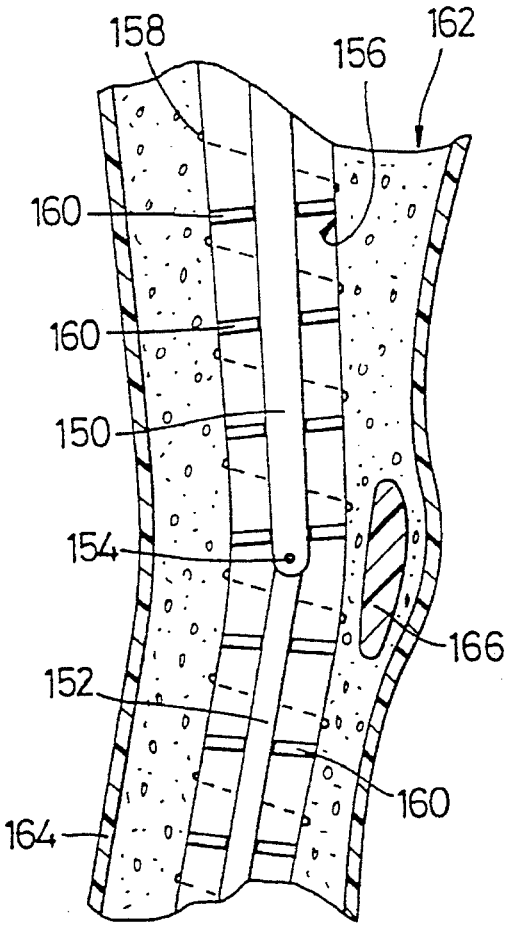

Referring now to FIG. 9(*a*) and (*b*), a preferred form of construction for the legs of a display comprises articulated leg frame members 150,152 hinged or pivoted at 154, similar to the arrangements shown in the two above embodiments. Surrounding the members 150,152 is a flexible tubular element 156 reinforced against collapsing by a spiral-wound rib 158, and secured to the leg members by spacer elements 160. Towards the upper end of the upper leg or thigh member 150 the spacer members are slotted so that they allow limited lateral movement of the tube and the foam 162 and surrounding skin 164 relative to the leg member 150, as shown by arrows A. The tubular element 158 is surrounded by foam 162 which is encased by a rubber skin 164. In front of the hinge or pivot 154 is a simulated patella 166 which "floats" between the tubular element and the skin. The patella is preferably relatively rigid and may comprise a stiff rubber insert.

The leg may be made by forming a plaster mould corresponding to the outer surface of the leg, swill moulding a latex outer "skin" by introducing latex into the mould, leaving it there for 1–2 hours until a skin 164 of required thickness has fully or partially set, swilling out the liquid latex and leaving the skin 164 to cure or dry. Once the skin 164 is cured/dry, an assembly comprising the leg frame members 150,152 and the tubular element 156 is located in the correct position within the skin 164, with the patella 166 if required, and then the space between the skin 164 and the tubular element 156 filled with a foam or foamable material 162. Thereafter the formed limb may be removed from the mould. This construction allows realistic flexing movement of the leg without collapse at the knee.

In some applications, the tubular element may be replaced by a perforate member or a helically wound reinforcement such as a spring.

It will be understood that the buttocks may be simulated in a manner similar to the patella, e.g. by providing a floating cup- or dish-shaped insert of less compressible material in the foam filling. In this case, the buttock inserts can be attached to the hip bar 52 to impart a lifelike swaying action for a female model. The inserts and swaying mechanism hold the buttocks of the display in place and avoid any tendency to collapse.

For male models, the buttocks may be attached to a fixed hip bar.

I claim:

1. An animated display comprising:

a body frame means;

left and right arm members pivotally mounted in an upper region of said body frame means;

left and right leg members pivotally mounted in a lower region of said body frame means for respective movement about a generally common pivotal axis;

each of said leg members comprising an upper leg part articulated at a knee joint in the mid region of said leg member to a lower leg part for movement about an axis generally parallel to said common pivotal axis;

drive means for moving said arm members reciprocally and for moving said leg members reciprocally in synchronism therewith;

articulating means for articulating said lower leg parts relative to said upper leg parts and comprising, for each leg member, an elongate flexible drive element extending along said upper leg part and connected at one end region to said lower leg part, and means for extending or retracting said elongate flexible drive element to articulate the upper and lower leg parts of said leg member.

2. An animated display according to claim 1, wherein said drive means comprises a rotary drive means connected to a rocking drive member pivotally mounted on said frame means and respective link means connecting each arm member and each leg member to said rocking drive member, whereby movement of said rocking drive member applies reciprocal movement to said leg members.

3. An aminated display according to claim 2, including a hip simulating region comprising one or more surfaces for being moved to simulate the movement of a female's hips, and a hip rocker member for moving said one or more surfaces, said hip rocker member being connected by said link means to said rocking drive member, to move in predetermined relationship with said leg members.

4. An animated display according to claim 1, wherein said means for extending or retracting includes a cam follower means associated with said flexible drive element and a cam means driven by said drive means.

5. An aminated display according to claim 4, wherein the profile of said cam means is selected according to a particular action to be simulated by the display.

6. An animated display according to claim 5, wherein the profile of said cam means is generally convex except for a concave portion corresponding to a period when the lower part of the leg member is adjacent a lowest part of its locus of movement.

7. An aminated display according to claim 1, wherein each leg member comprises an inner articulated frame part at least partially surrounded by a foam casing to simulate the appearance of a human or animal leg.

8. An animated display according to claim 7, wherein each inner frame part is disposed within a flexible tubular member and secured therein at locations spaced along its length, said foam casing generally surrounding said tubular member.

9. An animated display according to claim 8, wherein said tubular member includes strengthening ribs.

10. An animated display according to claim 7, wherein said foam casing is at least partially covered by a skin of rubber or rubber-like material.

11. An animated display according to claim 7, wherein an insert element or region of relatively stiff material is disposed adjacent the articulated region to simulate a patella.

12. An animated display according to claim 7, wherein said foam casing is mounted on said frame part by means allowing limited movement of the casing relative to the frame part in a direction transverse to the plane of pivotal movement of the leg member.

13. An animated display according to claim 7, wherein said leg member comprises a moulded outer skin member, said articulated frame part being located within said outer skin member, and at least part of a space therebetween containing a foam or foamable material filling.

14. An animated display according to claim 7, wherein at least part of an outer surface of the display is covered with a stretchable covering material.

15. An animated display according to claim 1, wherein said elongate flexible drive element comprises a drive cable.

16. An animated display, comprising:

a body frame means;

left and right arm members pivotally mounted in an upper end region of said body frame means;

left and right leg members pivotally mounted in a lower end region of said body frame means for respective movement about a common generally pivotal axis;

drive means disposed generally within said body frame means and comprising a rotary drive means connected to a rocking drive member pivotally connected to said frame means;

left arm link means coupling said left arm member to said rocking member;

right arm link means coupling said right arm member to said rocking member;

left leg link means coupling said left leg member to said rocking member;

right leg link means coupling said right leg member to said rocking member, whereby in use said left and right arm members and said left and right leg members are moved reciprocally in synchronism on operation of said drive means.

* * * * *